US008434651B2

(12) United States Patent
Miyazaki et al.

(10) Patent No.: US 8,434,651 B2
(45) Date of Patent: May 7, 2013

(54) POURING MEMBER

(75) Inventors: Akihito Miyazaki, Yokohama (JP); Hiroaki Hayashi, Yokohama (JP); Kimio Takeuchi, Yokohama (JP); Yasuyuki Takeuchi, Yokohama (JP); Manabu Hosokawa, Yokohama (JP)

(73) Assignees: Toyo Seikan Kaisha, Ltd., Tokyo (JP); Meijo Co., Ltd., Tokyo (JP)

( * ) Notice: Subject to any disclaimer, the term of this patent is extended or adjusted under 35 U.S.C. 154(b) by 432 days.

(21) Appl. No.: 12/734,188

(22) PCT Filed: Oct. 17, 2008

(86) PCT No.: PCT/JP2008/068850

§ 371 (c)(1),
(2), (4) Date: Apr. 16, 2010

(87) PCT Pub. No.: WO2009/051221

PCT Pub. Date: Apr. 23, 2009

(65) Prior Publication Data

US 2010/0206915 A1 Aug. 19, 2010

(30) Foreign Application Priority Data

Oct. 19, 2007 (JP) ..... 2007-272780

(51) Int. Cl.

| | |
|---|---|
| ***B65D 47/10*** | (2006.01) |
| ***B67B 1/00*** | (2006.01) |
| ***B65D 5/72*** | (2006.01) |
| ***G01F 11/00*** | (2006.01) |

(52) U.S. Cl.
USPC ..... 222/541.8; 222/153.14; 222/153.1; 222/568; 222/570; 214/216; 214/217; 214/218; 214/250; 214/253; 215/48; 215/49

(58) Field of Classification Search ..... 222/541.5, 222/541.8, 546, 570, 153.09, 153.1; 215/209, 215/216–218, 250, 253, 47–49
See application file for complete search history.

(56) References Cited

U.S. PATENT DOCUMENTS

| | | | | |
|---|---|---|---|---|
| 2,762,537 | A * | 9/1956 | Reinhardt, Jr. | 222/537 |
| 3,680,745 | A * | 8/1972 | Landen | 222/570 |
| 3,910,463 | A * | 10/1975 | Reese | 222/153.14 |
| 4,002,275 | A * | 1/1977 | Crowle et al. | 222/543 |

(Continued)

FOREIGN PATENT DOCUMENTS

| | | |
|---|---|---|
| JP | U-S58-46751 | 3/1983 |
| JP | 2002-293361 | 10/2002 |
| JP | 2006-27662 A | 2/2006 |

*Primary Examiner* — Kevin P Shaver
*Assistant Examiner* — Nicholas J Weiss
(74) *Attorney, Agent, or Firm* — Manabu Kanesaka

(57) ABSTRACT

A pouring member includes an unsealing cap and at least two rotation prevention sections extending vertically and downwardly from an end surface of an open end side of the unsealing cap and is arranged such that the at least two rotation prevention sections are apart from one another by an angle which is larger than a rotation angle required for twisting off the sealing part, and symmetrically with respect to the central axis of the unsealing cap. A recess is formed such that the recess opens to a front end side of the rotation prevention section, and an engagement projection engages the recess in a direction substantially parallel with a direction in which the rotation prevention sections are extended vertically and downwardly, and is formed at a specific position of the flange part of the pouring member.

9 Claims, 9 Drawing Sheets

U.S. PATENT DOCUMENTS 4,334,638 A * 6/1982 Stock ..... 222/153.1
4,413,753 A * 11/1983 Stock ..... 222/149
4,756,435 A * 7/1988 Schick et al. ..... 215/216
5,131,571 A * 7/1992 Nolley ..... 222/1
5,228,599 A * 7/1993 Keller ..... 222/137
5,249,695 A * 10/1993 Luch et al. ..... 220/276
5,275,312 A * 1/1994 Labruzzo ..... 222/212
5,509,580 A * 4/1996 Glynn ..... 222/153.1
5,560,505 A * 10/1996 Schneider et al. ..... 215/330
5,657,905 A * 8/1997 Glynn ..... 222/153.1
5,740,792 A * 4/1998 Ashley et al. ..... 128/203.15
5,788,122 A * 8/1998 Keller ..... 222/137
6,076,712 A * 6/2000 Esber et al. ..... 222/527
6,315,165 B1 * 11/2001 Regan ..... 222/103
6,564,972 B2 * 5/2003 Sawhney et al. ..... 222/137
6,854,612 B2 * 2/2005 Thomson ..... 215/21
6,962,275 B2 * 11/2005 deCler et al. ..... 222/570
7,175,057 B2 * 2/2007 Mutterle ..... 222/420
7,648,051 B1 * 1/2010 Montgomery et al. .. 222/153.09
8,033,429 B2 * 10/2011 Keller ..... 222/145.6
2003/0230546 A1 * 12/2003 Yurkewicz et al. ..... 215/251
2004/0133161 A1 * 7/2004 Trocki et al. ..... 604/131
2005/0045579 A1 * 3/2005 Weiler et al. ..... 215/277
2009/0163859 A1 * 6/2009 Lloyd et al. ..... 604/77
2012/0191067 A1 * 7/2012 Chia et al. ..... 604/506

* cited by examiner (a)

(b)

POURING MEMBER

RELATED APPLICATIONS

The present application is based on international Application No. PCT/JP2008/068850, filed Oct. 17, 2008, and claims priority from, Japanese Application Number 2007-272780, filed Oct. 19, 2007, the disclosure of which is hereby incorporated by reference herein in its entirety.

TECHNICAL FIELD

The invention relates to a pouring member to be attached to a container which fills and seals fluid contents, thereby to form a pouring mouth for the contents.

BACKGROUND OF THE INVENTION

Conventionally, as a container in which fluid contents are filled and sealed, a bag-like container (pouch) obtained by forming a flexible packaging material such as a resin film into a bag has been known. In medical institutions such as hospitals, these bag-like containers are widely used as a container for filling and sealing enteric nutrients, liquid diets, liquid medicines or the like. In order to pour these contents for administrating to patients, a nozzle-like pouring member is used, and one example thereof is shown in Patent Document 1.

Patent Document 1: JP-A-2002-293361

DISCLOSURE OF THE INVENTION

Problems to be Solved by the Invention

The pouring member (container capping member) of Patent Document 1 has a configuration in which a stopper engaged with an unsealing cap is twisted off by rotating an unsealing cap with respect to a pouring cylinder, thereby realizing sanitary unsealing without directly touching the pouring cylinder.

However, the pouring member having an unsealing mechanism as mentioned above has the following problem. Specifically, for example, when the unsealing cap is rotated during transportation or when filling and sealing contents, the stopper may be twisted off to cause the contents to be leaked out. Therefore, it is desired that unnecessary rotation of the unsealing cap be prevented when not used.

In addition, the stopper is hidden under the unsealing cap. Therefore, when unsealing, a user cannot visibly confirm that the stopper has been twisted off, which makes difficult for a user to judge whether unsealing by twisting off of the stopper has been completed. Accordingly, problems have been pointed out that working hours are spent wastefully since the unsealing cap is rotated a larger number of times than required, that contents are leaked out when an attempt is made to pull out the unsealing cap forcedly when the stopper remains untwisted due to insufficient rotation of the unsealing cap, or the like.

In addition, in applications where use in medical institutions such as hospitals is assumed, in order to prevent medical mistakes before they happen, erroneous use is prohibited by limiting the shape of a pouring member in accordance with a director's notice. Therefore, when an unsealed pouring member is inserted into a tube such as a catheter in order to administrate the contents to a patient, it is difficult to allow a pouring member to correspond to all types of catheters differing in diameter.

Accordingly, for catheters with relatively large diameters to which a pouring member cannot be inserted as it is, an adapter is used in order to allow the outer diameter of the pouring mouth of a pouring member to be adapted to the inner diameter of a catheter. In this case, it is desired that a user can confirm easily whether a pouring member is firmly attached to an adapter and that loosening after the attachment can be prevented.

When an adapter is used in combination, there may be a case where an empty container of which the contents have been administrated is exchanged with a new one with the adapter still being inserted into a catheter and, during such exchange, another liquid medicine is administrated to a patient by means of a catheter tip syringe. If an adapter is used repeatedly in this way, it is required that sealing performance of an adapter for a pouring member or a catheter tip syringe be prevented from being deteriorated so that no liquid leakage occurs. In particular, when administration by means of a catheter tip syringe is performed, the tip of a catheter tip syringe is pushed to the sealing surface in an adapter. In such a case, the sealing surface in an adapter may be deformed by an applied pressure. Therefore, sealing performance of an adapter to a pouring member has to be maintained while taking possible deformation of the sealing surface in an adapter into consideration.

In attaching a pouring member to an adapter, threads may be formed on the side surface of a pouring cylinder to permit attachment by screwing.

However, if such threads are formed on the side surface of a pouring cylinder, the following problem may occur. Specifically, when a pouring cylinder is directly inserted into a catheter of which the inner diameter is not as large as one which requires an adapter, depending on the material of a catheter, the opening thereof may be widened and lies on the threads. As a result, contents which have been poured are caused to run down the threads revolving the side surface of the pouring cylinder, and then are leaked out.

For such type of a catheter, for example, it may be possible that an adapter is forcedly inserted into a catheter, and then a pouring member is attached to this adapter. However, such a complicated work not only may impose a heavy burden on a user but also may damage a catheter.

The present invention has been made in view of the above-mentioned circumstances, and the object thereof is to provide a pouring member which is provided with an unsealing mechanism by which the pouring member is unsealed by rotating an unsealing cap, prevents unnecessarily rotation of the unsealing cap, allows a user to easily judge the completion of unsealing, as well as can solve various problems associated with the combined use of an adapter.

Means for Solving the Problems

The pouring member of the present invention has a configuration in which the pouring member comprises a pouring member main body and a cylindrical unsealing cap having one end thereof being closed and is coaxially attached to said pouring member main body, wherein said pouring member main body has a pouring cylindrical part extending cylindrically from a base and a sealing part formed at the tip of said pouring cylindrical part through a thin wall part, and said sealing part is twisted off with said thin wall part by rotating said unsealing cap which is engaged with said sealing part around the central axis, two or more rotation prevention sections are extended vertically and downwardly and symmetrically with respect to the central axis, and, at substantially the center of the width direction of each rotation prevention section, a recess is formed such that it opens to the front end side of the rotation prevention section, an engagement projection to be engaged with said recess in a direction almost parallel with the direction in which said rotation prevention sections are extended vertically and downwardly is formed at a specific position of a flange part provided in a boundary between said base part and said pouring cylindrical part of said pouring member main body.

Advantageous Effects of the Invention

By the above-mentioned configuration, by causing the rotation prevention sections extending vertically and downwardly from the unsealing cap to be engaged with the engagement projection which projects on the pouring member main body, unnecessary rotation of the unsealing cap can be prevented. At least when the rotation prevention sections and the engagement projection are released from the engagement, the rotation prevention section elastically deforms to restore while vibrating, and allows a user to have a feel of clicking. A user can recognize easily the start of unsealing by this feel of clicking.

BEST MODE FOR CARRYING OUT THE INVENTION

The preferred embodiments of the present invention will be explained hereinbelow with reference to the drawings.

Figure 1:
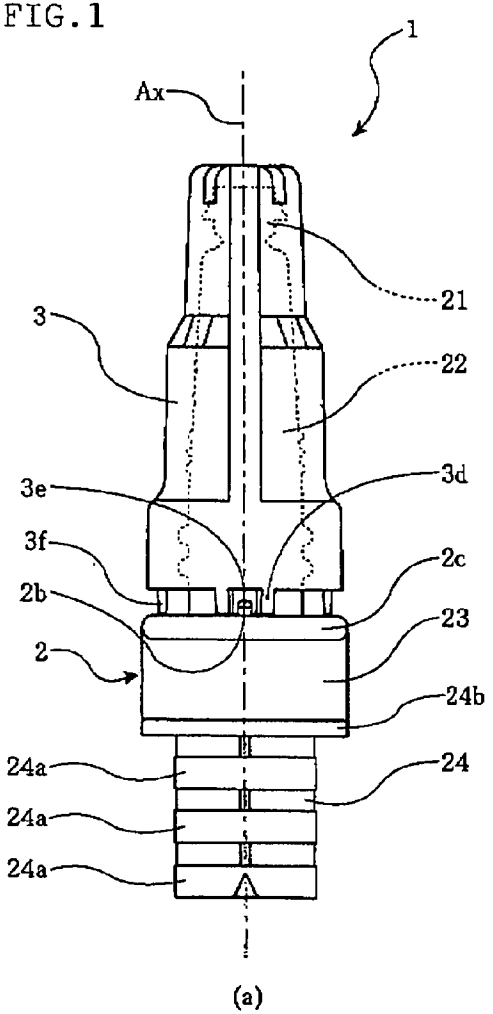
FIG. 1 is an explanatory side view of the pouring member of the present invention.
Figure 1:
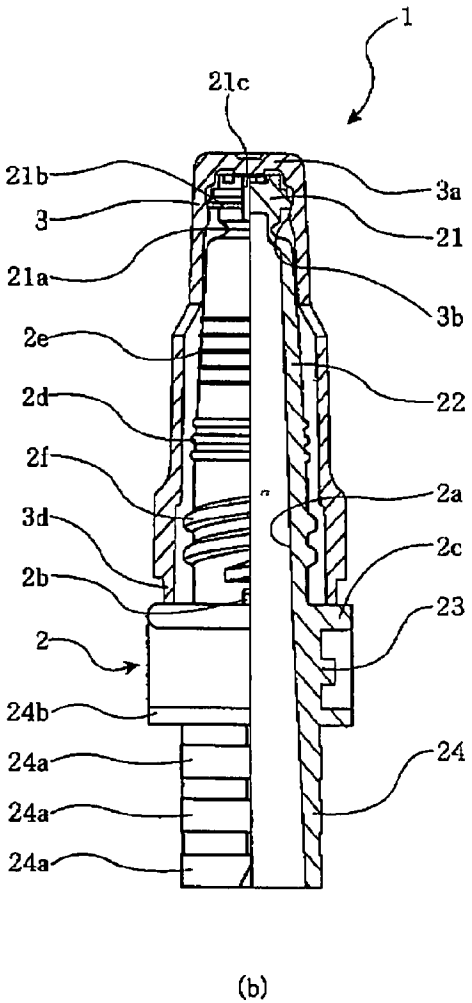
Figure 2:
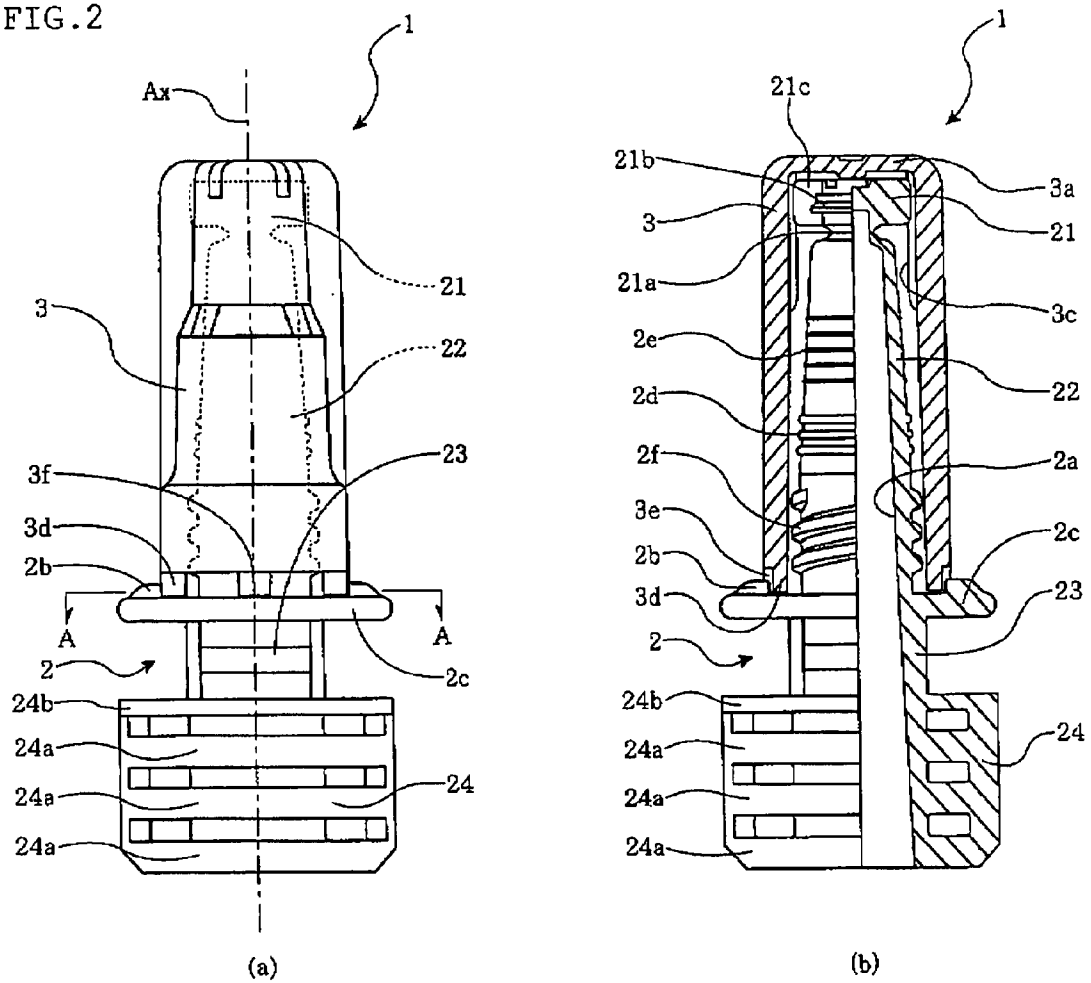
FIG. 2 is an explanatory front view of the pouring member of the present invention.

FIG. 1 is an explanatory view showing the side of the pouring member according to this embodiment, and FIG. 2 is an explanatory view showing the front thereof.

The pouring member 1 shown in these figures is provided with a pouring member main body 2 and an unsealing cap 3 to be attached to the pouring member main body 2. As mentioned later, the pouring member 1 may be provided with an adapter 4 (see FIG. 6). The pouring member main body 2, the unsealing cap 3 and the adapter 4 can be produced by a molding method such as injection molding by using a thermoplastic resin such as a polyolefin-based resin such as polypropylene and polyethylene.

Figure 3:
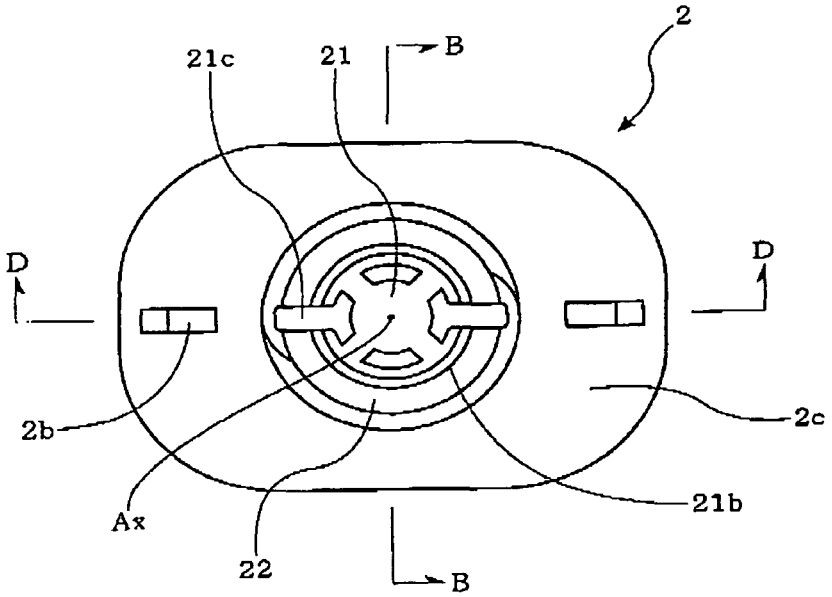
FIG. 3 is an explanatory plan view of the pouring member of the present invention.
Figure 3:
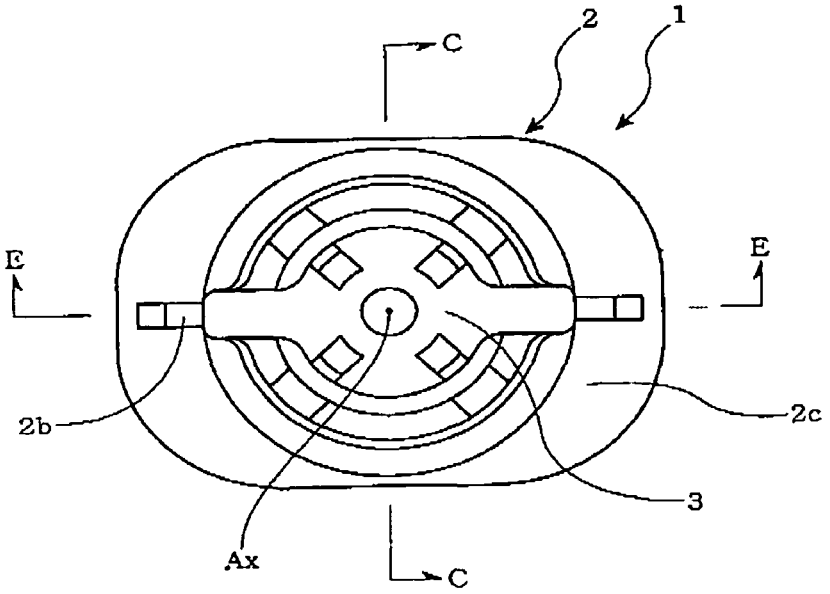

Here, FIG. 1(*a*) is a side view of the pouring member 1, and FIG. 1(*b*) is a notched cross-sectional view of the essential parts thereof. FIG. 2(*a*) is a front view of the pouring member 1 and FIG. 2(*b*) is a notched cross-sectional view of the essential parts thereof. FIG. 3(*a*) shows a plan view of the pouring member main body 2 and FIG. 3(*b*) is a plan view of the pouring member 1. The cross sections of the pouring member main body 2 shown in FIG. 1(*b*) and FIG. 2(*b*) (the cross section shown in the right half of the pouring member main body 2 in each figure) respectively corresponds to the cross section taken along line B-B and the cross section taken along line D-D in FIG. 3(*a*). The cross sections of the unsealing cap 3 of FIG. 1(*b*) and FIG. 2(*b*) respectively correspond to the cross section taken along line C-C and the cross section taken along line E-E in FIG. 3(*b*).

In this embodiment, the pouring member main body 2 has a base part 23, a pouring cylindrical part 22 which cylindrically extends from the base part 23 upwardly in the figure, a sealing part 21 which is formed at the tip of the pouring cylindrical part 22 through a thin wall part 21*a*, and a boat-like part 24 positioned below the base part 23 in the figure. As shown, the base part 23 and the boat-like part 24 penetrate the inside of the pouring cylindrical part 22 so that they intercommunicate with the pouring cylindrical part 22 so as to form a liquid passage 2*a* therein.

The boat-like part 24 of the pouring part main body 2 will serve as a welding part when the pouring member 1 is attached to a container such as a pouch, which is obtained by forming into a bag a soft packaging material such as a resin film, as a pouring mouth of the contents. The boat-like part 24 has three welding substrates 24*a* extending right and left in the figure and a positioning substrate 24*b* positioned between the welding substrates 24*a* and the base part 23. The positioning substrate 24*b* is caused to abut the side of a soft packaging material constituting the pouch, thereby to conduct positioning, and the soft packaging material is then welded to the side surface of the welding substrate 24*a* while conducting the positioning, whereby the pouring member 1 can be attached to the pouch.

On the other hand, the unsealing cap 3 is a cylindrical member with its one end being closed by a top plate 3*a*, and is attached to the pouring member main body 2 by capping such that it is engaged with the sealing part 21, thereby to cover the surroundings of the pouring cylindrical part 22.

In FIGS. 1(*a*) and 2(*a*), part of the pouring member main body 2 which is covered by the unsealing cap 3 is indicated by a chain line.

In order to allow the unsealing cap 3 to be engaged with the sealing part 21 of the pouring member main body 2, for example, a projection part 21*b* is formed on the sealing part 21 such that it projects in the form of a flange along the periphery thereof. At the same time, an engagement rib 3*b* which is engaged with this projection 21*b* is formed on the inner peripheral surface of the unsealing cap 3. As a result, when the unsealing cap 3 is attached to the pouring member main body 2, the engagement rib 3*b* formed in the unsealing cap 3 moves across the projection part 21*b* formed in the sealing part 21, whereby the unsealing cap 3 and the sealing part 21 can be engaged with each other.

The unsealing cap 3, at a position where it is coaxially attached to the pouring member main body 2, is allowed to rotate around the central axis (Ax) thereof. The sealing part 21, which has been engaged with the unsealing cap 3, is then twisted off by the thin wall part 21*a*, thereby allowing the pouring cylindrical part 22 to open (see FIG. 5). As a result, the contents of the pouch pass through the liquid passage 2*a* and are poured through the tip of the pouring cylindrical part 22.

Figure 5:
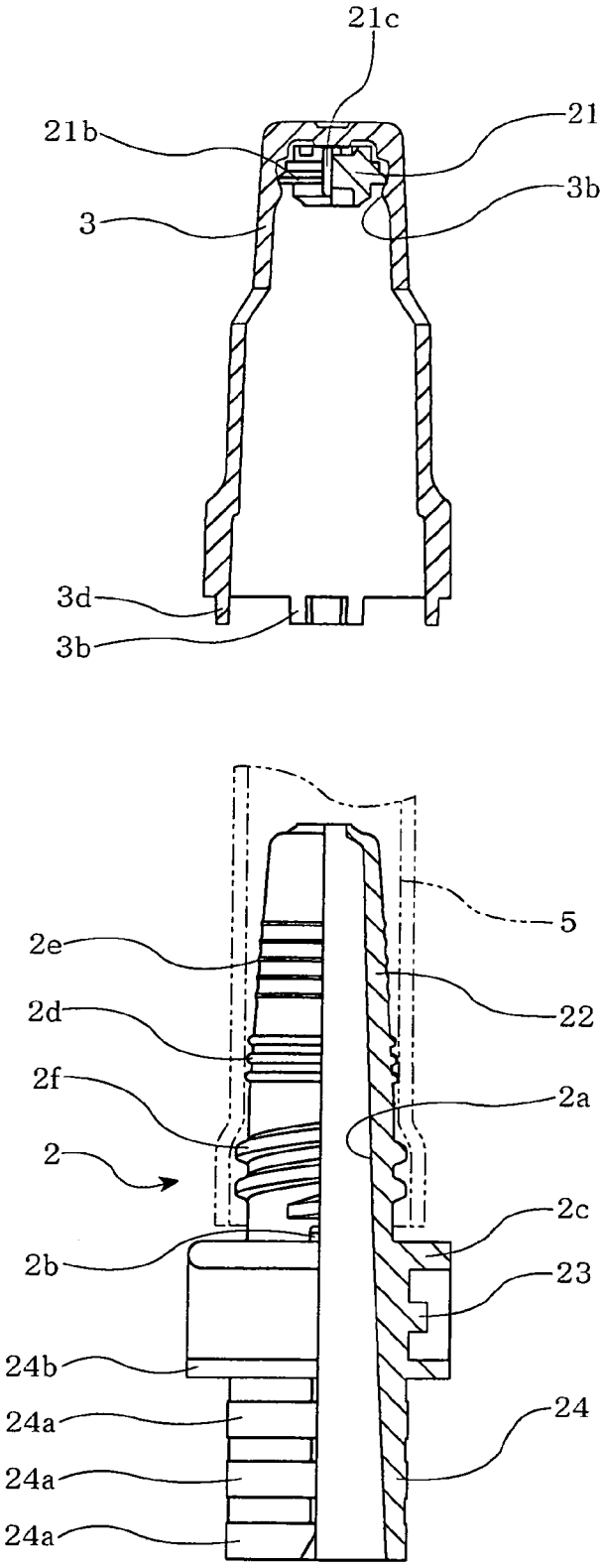
FIG. 5 is an explanatory view showing the state in which the unsealing cap is removed from the pouring member main body.

Meanwhile, FIG. 5 is a notched cross-sectional view of essential parts showing the state where the unsealing cap 3 has been removed from the pouring cylinder main body 2. The cross section thereof is also shown as in the case of FIG. 1(*b*).

In order to allow the sealing part 21 to be twisted off by the unsealing cap 3, for example, as shown in the figure, a pair of extending sections 21*c* which extend in the radial direction thereof are formed in the sealing part 21, and an engagement groove 3*c* in which this extending section 21 is engaged may be formed on the inner peripheral surface of the unsealing cap 3. As a result, when the unsealing cap 3 is rotated around the central axis (either left or right), the sealing part 21 is rotated with this rotation, and then twisted off by the thin wall part 21*a*.

The sealing part 21 which has been twisted off can be prevented from dropping from the unsealing cap 3 by allowing it to remain engaged with the unsealing cap 3.

By attaching the unsealing cap 3 to the pouring member main body 2 in this way, with the pouring cylindrical part 22 of the pouring member main body 2 being covered with the unsealing cap 3, it is possible to unseal the pouring cylindrical part 22 by twisting off the sealing part 21 to allow the contents in the pouch to be poured without the fear that the fingers of a user touch the pouring cylindrical part 22. That is, for example, a user can twist the sealing part 21 off sanitarily without touching the pouring cylindrical part 22 only by rotating the unsealing cap 3 with one hand while holding the base part 23 of the pouring member main body 2 with another hand.

In the unsealing cap 3, rotation prevention sections 3*d* for preventing unnecessary rotation of the unsealing cap 3 are formed. The rotation prevention sections 3*d* are formed such that they vertically extend downwardly from the end surface of the open end side of the unsealing cap 3. As shown in the figure, almost center in the width direction of the rotation prevention section 3*d*, a recess 3*e* which opens on the front end side of the rotation prevention section 3*d* is formed. An engagement projection 2*b* formed on the pouring member main body 2 is engaged with this recess 3*e* in a direction almost parallel to the direction in which the rotation prevention sections 3*d* is extended vertically and downwardly, whereby unnecessary rotation of the unsealing cap 3 can be suppressed. As a result, twisting off of the sealing part 21 when not used can be prevented.

The engagement projection 2*b* formed on the pouring member main body 2 and the rotation prevention sections 3*d* formed on the unsealing cap 3 can also be used for positioning when the unsealing cap 3 is capped on the pouring member main body 2.

The rotation prevention sections 3*d* are arranged symmetrically with respect to the central axis of the unsealing cap 3. In the shown examples, two rotation prevention sections 3*d* are arranged such that they are opposed, i.e. 180 degrees apart. As shown in figures, as for the engagement projection 2*b* formed on the pouring member main body 2, a flange part 2*c* is provided in a boundary between the pouring cylindrical part 22 and the base part 23, and the engagement projection 2*b* may be provided on a specific position of the flange part 2*c* corresponding to the rotation prevention section 3*d* formed in the unsealing cap 3.

Figure 4:
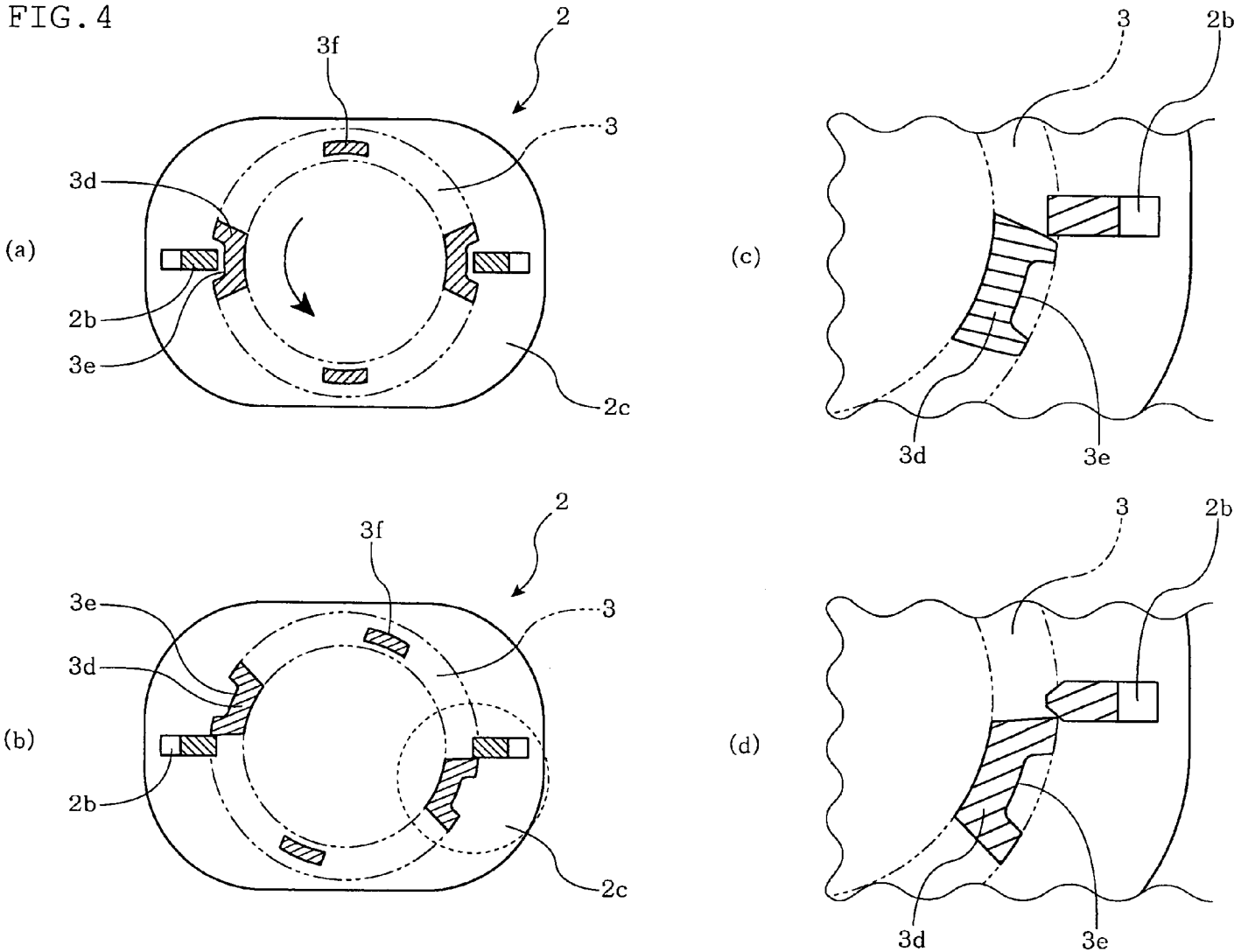
FIG. 4 is an explanatory cross-sectional view taken along line A-A in FIG. 2(*a*)

In the shown example, when the sealing part 21 is twisted off, the unsealing cap 3 is rotated in the state shown in FIG. 4(*a*). At this time, the rotation prevention sections 3*d* are released from the engagement with the engagement projection 2*b* while undergoing elastic deformation as if they are pushed away by the engagement projection 2*b*. Vibration which occurs when the rotation prevention sections 3*d* are separated from the engagement projection 2*b* to restore is transmitted to a user as a feel of clicking.

Furthermore, when the unsealing cap 3 makes an almost half turn around the central axis, as shown in FIG. 4(*b*), the rotation prevention section 3*d* abuts the opposite engagement projection 2*b*, and as a result, the unsealing cap 3 will not rotate any more, or will be hard to rotate.

Therefore, in the example shown in FIG. 4(*b*), by appropriately adjusting the thickness, the material or the like of the thin wall part 21*a* such that the rotation angle required for the sealing part 21 to be twisted off becomes smaller than 160°, for example, due to the feel that the rotation of the unsealing cap 3 has been stopped, it is possible to allow a user to know sensibly that the twisting off of the sealing part 21 has been completed or was already completed.

That is, in this embodiment, the timing of unsealing is known to a user by single feel of clicking, and the completion of unsealing is known to a user by stopping the rotation of the unsealing cap 3 in the state shown in FIG. 4(*b*). In this way, a user can know sensibly when unsealing is started and when unsealing is completed. At the same time, the actual sealing is completed and the unsealing cap 3 is in the state they can be pulled up upwardly.

When the unsealing cap 3 is further rotated in the abutted state shown in FIG. 4(*b*), the engagement projection 2*b* is fitted into the recess 3*e* while pushing the rotation prevention section 3*d* aside, whereby the engagement projection 2*b* is engaged with the rotation prevention section 3*d*. Also at this time, a feel of clicking caused by vibration derived from the rotation prevention sections 3*d* restore to their original shapes is transmitted to a user.

By appropriately adjusting the thickness, the material or the like of the thin wall part 21*a* such that the rotation angle required for the sealing part 21 to be twisted off becomes smaller than 180°, it is possible that the completion of the unsealing of the sealing part 21 and the start of the unsealing of the sealing part 21 are respectively known to a user by a single feel of clicking (twice feels of clicking in total).

Specifically, the start of unsealing is known to a user by a first feel of clicking. After the actual completion of the twisting off of the sealing part 21, by a second feel of clicking, it is possible to allow a user to sensibly know that twisting off of the sealing part 21 has been completed or was already completed. Simultaneously, the actual sealing is completed, and the unsealing cap 3 is in the state they can be pulled upwardly.

Due to the above-mentioned configuration, troubles that, when the sealing part 21 is twisted off, the unsealing cap 3 is unnecessarily rotated to cause the work time to be consumed wastefully, a user spills the contents over when he or she tries to pull the unsealing cap 2 out forcefully with the twisting off of the sealing part 21 remaining uncompleted due to insufficient rotation of the unsealing cap 3 or other problems can be avoided.

Here, the cross section shown in FIG. 4 corresponds to the cross section taken along line A-A in FIG. 2(*a*), and the end surface on the open end side of the unsealing cap 3 is shown by a double dashed line.

At this time, in FIG. 4(*b*), if the engagement projection 2*b* and the rotation prevention section 3*d* are in a planer abutment, there may be a fear that the unsealing cap 3 is no longer rotated or is hard to be rotated. In contrast, as shown in FIGS. 4(*c*) and (*d*), at least one of the outer side surface of the recess 3*e* and the side surface of the engagement projection 2*b* is allowed to have an inclined surface or a curved surface, as in the case of the inner side surface of the recess 3*e*, so as to allow the engagement projection 2*b* to easily move over. As a result, the engagement projection 2*b* and the rotation prevention section 3*d* are allowed to be in the state of linear or point contact with each other, and the engagement projection 2*b* can be fitted to the recess 3*e* easily while pushing the rotation prevention section 3*d* away. FIGS. 4(*c*) and (*d*) correspond to a part surrounded by a chain line in FIG. 4(*b*).

The recess 3*e* may be in the form of a penetrating hole. However, when the unsealing cap 3 is capped on the pouring member main body 2, it is preferred that the bottom part of the recess 3*e* (the inner side surface nearer to the center of the unsealing cap 3) remain closed in order to prevent the strength from being lowered when an axial load is imposed. By adjusting the amount of engagement (the amount of interference) of the engagement projection 2*b* and the recess 3*e*, it is possible to allow the engagement projection 2*b* to abut the rotation prevention section 3*d* or to allow the engagement projection 2*b* to move over the rotation prevention section 3*d*.

A projection 3*f* which extends vertically and downwardly from the end surface of the open end side of the unsealing cap 3 together with the rotation prevention section 3*d* is formed according to need for the purpose of reinforcement in order to prevent the unsealing cap 3 to be inclined or to prevent the rotation prevention section 3*d* from being broken when an axial load is imposed during capping when the unsealing cap 3 is capped on the pouring member main body 2. As shown in FIG. 4, the projection 3*f* is formed such that it avoids interference with the engagement projection 2*b*, as shown in FIG. 4. In addition, the projection chip 3*f*, together with the rotation prevention section 3*d*, specifies the distance in the direction of the central axis (height direction) with the engagement rib 3*b*. It is preferred that the length be specified such that the projection part 21*b* of the pouring member main body 2 be suitably engaged with the engagement rib 3*b*.

The pouring member 1 as mentioned above can be used by attaching to a pouch in which contents such as an enteric nutrient, a liquid diet, a liquid medicine or the like are filled and sealed. Then, the unsealing cap 3 is removed by twisting off the sealing part 21, and the unsealed pouring cylindrical part 22 is inserted into a tube such as a catheter to allow the contents to be poured such that they are administrated to a patient. In applications where use in medical institutions such as hospitals can be assumed, the shape of the pouring member main body 2 is restricted by the regulation specified in a director's notice. As a result, it will be difficult to allow the pouring main body 2 to correspond to all catheters differing in inner diameter. For catheters having a diameter to which the pouring member main body cannot correspond, in order to adapt the outer diameter of the pouring mouth to the inner diameter of the catheter, an adapter 4 shown in FIG. 6 is used in combination.

Figure 6:
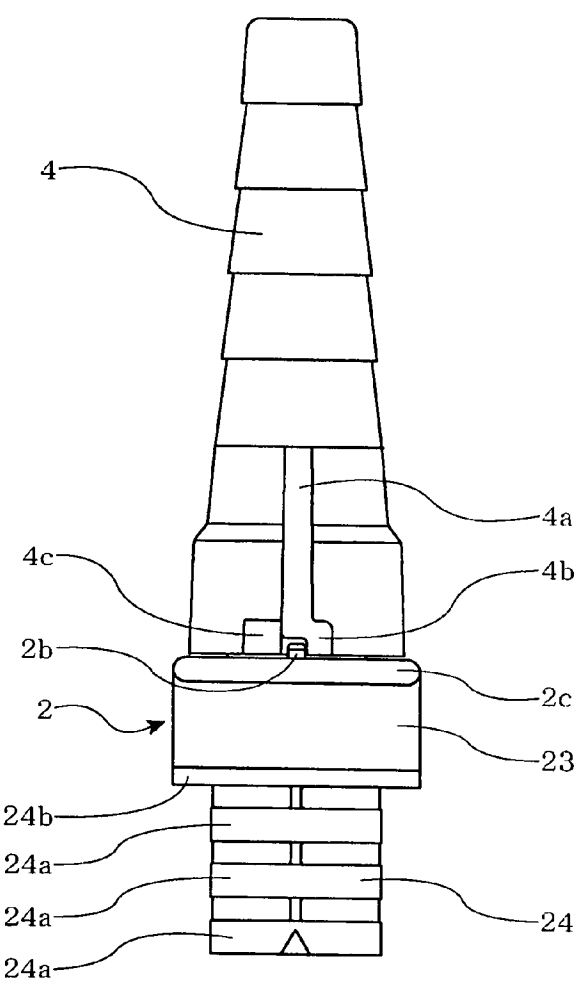
FIG. 6 is an explanatory view showing the state in which an adapter is screwed to the pouring member main body.
Figure 6:
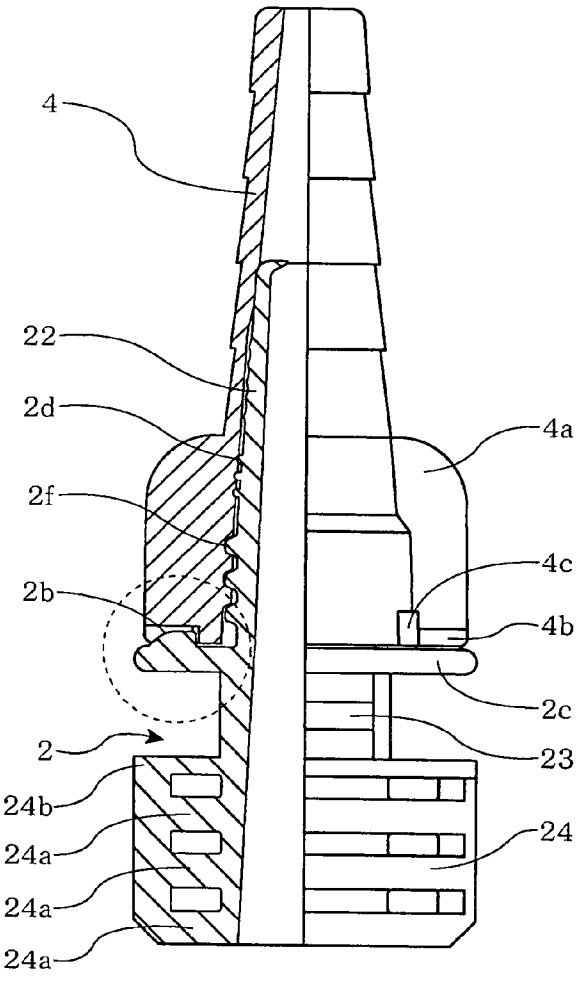
Figure 7:
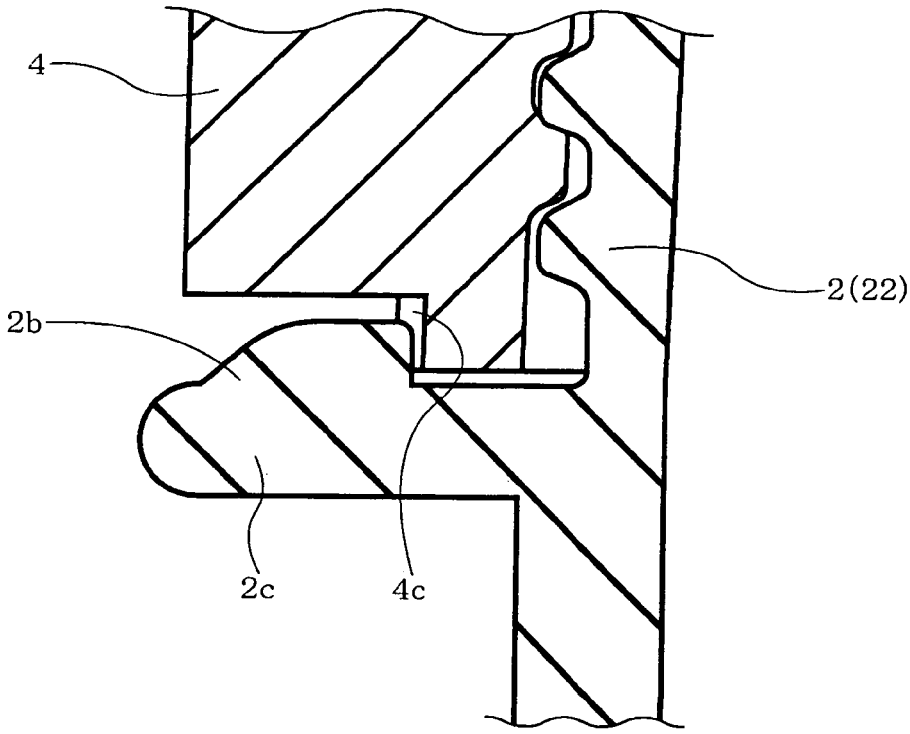
FIG. 7 is an enlarged view of a part indicated by a chain line in FIG. 6(*a*)
Figure 8:
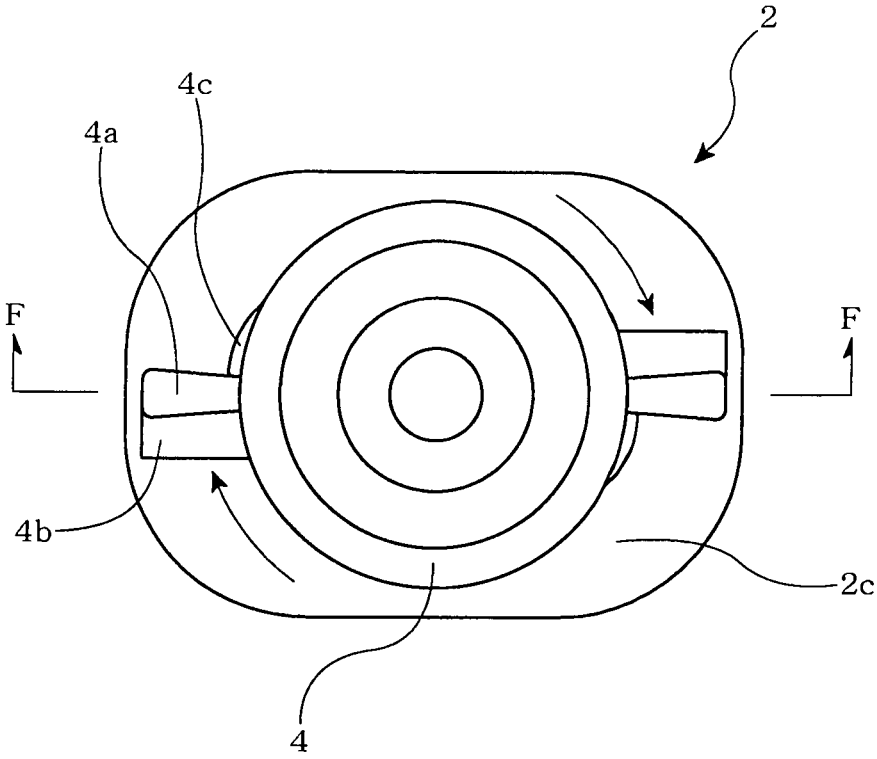
FIG. 8 is a plan view showing the state in which an adapter is screwed to the pouring member main body.

Here, FIG. 6(*a*) is a notched cross-sectional view of essential parts showing the front of the pouring member main body 2, which is in the state where the adapter 4 is screwed to the pouring member main body 2 from which the unsealing cap 3 has been removed by opening the pouring cylindrical part 22. FIG. 7 is an enlarged view of a part surrounded by a chain line in FIG. 6(*a*). The cross section shown in FIG. 6(*a*) (a cross section shown in the left half in the figure) corresponds to the section taken along line F-F in FIG. 8. FIG. 8 is a plan view showing a state in which the adapter 4 is screwed, and in the figure, the screwing direction of the adapter 4 is shown by an arrow. FIG. 6(*b*) is a side view showing the state in which the adapter 4 is screwed.

The adapter 4 is a cylindrical member which is coaxially screwed to the pouring cylindrical part 22 of the pouring member main body 2. Threads 2*f* for screwing the adapter 4 are formed on the outer peripheral surface of the pouring cylindrical part 22. During the actual use, a pouch can be exchanged by allowing the adapter 4, which is connected to a catheter, to be removed from or installed to the pouring member main body 2. For this purpose, it is preferred that the screwing angle of the adapter 4 be about 45 to 270° in order to prevent the catheter from being twisted during the exchange of a pouch.

In the shown example, on the side surface of the adapter 4, a pair of wing parts 4*a* which serve as a grip for screwing the adapter 4 are formed such that they extend symmetrically in the radial direction. As shown in FIG. 6(*b*), the lower end side of the wing parts 4*a* in the figure is bent in the direction opposite to the screwing direction to form an abutment part 4*b*. This abutment part 4*b* is allowed to abut the engagement projection 2*b* when the pouring part main body 2 is screwed to the adapter 4 and the engagement projection 2*b* projected on the flange part 2*c* and the wing part 4*a* formed on the adapter 4 are arranged in parallel on the same plane which includes the central axis of the pouring member main body 2.

Due to such a configuration, further rotation of the adapter 4 can be prevented. At the same time, by determining in advance the position of the wing part 4*a* when the screwing is completed, a user can easily judge that the screwing is completed only by visually confirm the position of the wing part 4*a*.

On the side surface along the end edge on the side opposite to the flange part 2*c* of the adapter 4, not only the abutment part 4*b* as mentioned above is formed, but also a loosening prevention rib 4*c* for preventing the adapter 4 which has been screwed to the pouring member main body 2 from loosening is formed. This loosening prevention rib 4*c* has an inclined surface of which the height from the side surface of the adapter 4 increases in the direction opposite to the screwing direction. When the pouring member main body 2 is screwed to the adapter 4, the engagement projection 2*b* projecting on the flange part 2*c* moves over the inclined surface and enters between the abutment part 4*b* and the loosening prevention rib 4*c*.

As a result, the engagement projection 2*b* is sandwiched between the abutment part 4*b* and the loosening prevention rib 4*c*, whereby the rotation of the adapter 4 in a direction opposite to the screwing direction is inhibited, and the adapter 4 is prevented from being loosened.

Figure 9:
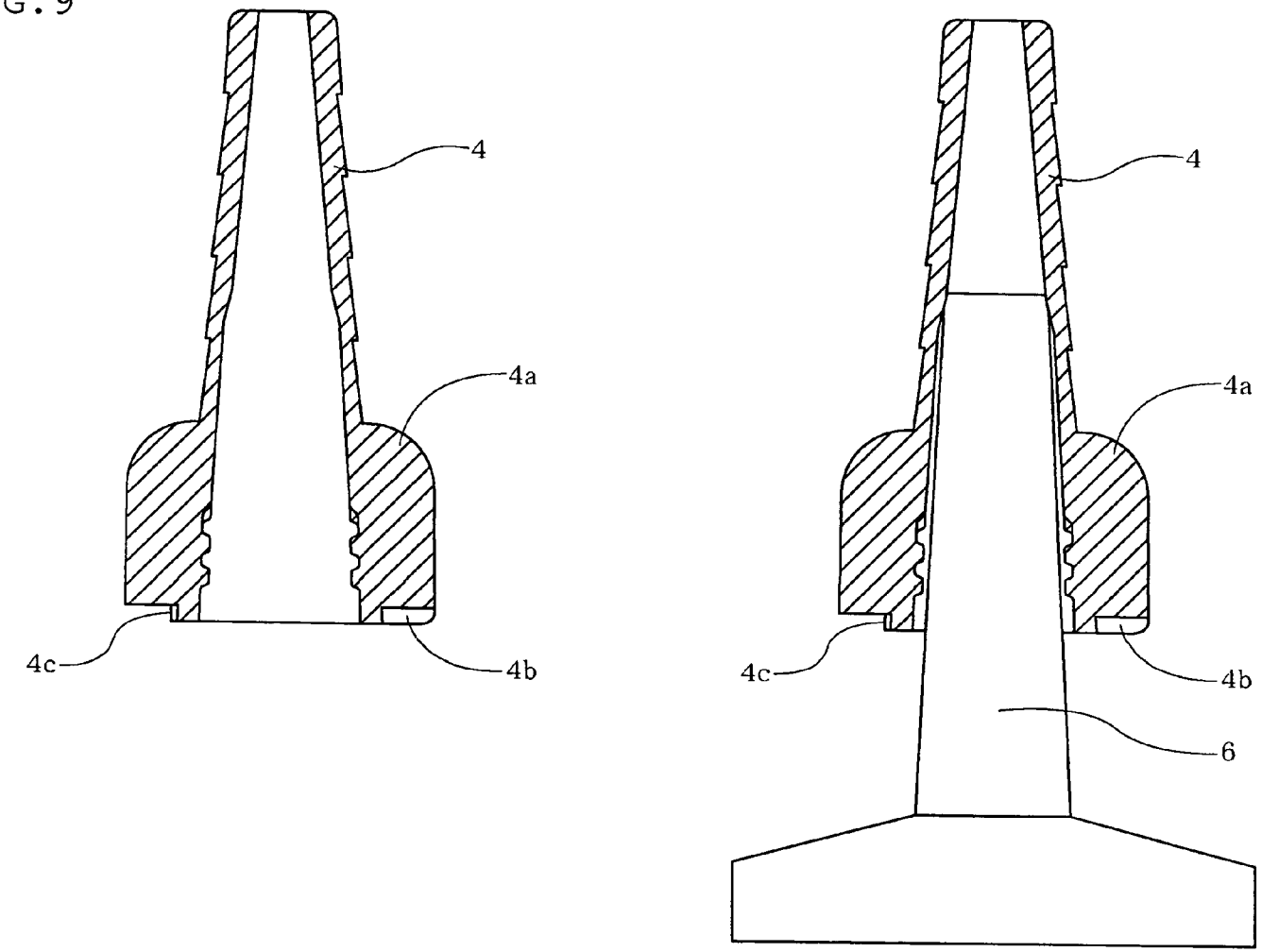
FIG. 9 are vertical cross-sectional view (cross-sectional view taken along line F-F) of an adapter and an explanatory view showing the state in which a catheter tip cylinder is pushed into the adapter.

In addition, a liquid medicine or the like may be administrated from the adapter 4 connected to a catheter through a catheter tip syringe 6 (see FIG. 9).

Here, FIG. 9(*a*) shows a vertical cross-sectional view of the adapter 4, and FIG. 9(*b*) is a cross-sectional view showing the state where the cylinder tip of the catheter tip syringe 6 is pushed to the sealing surface in the adapter 4. The cross sections of the adapter 4 shown in these figures correspond to the cross section taken along line F-F in FIG. 8.

When a liquid medicine or the like is administrated in this way, as shown in FIG. 9(*b*), pouring from the catheter tip syringe 6 is conducted while enhancing the sealing property between the catheter tip syringe 6 and the adapter 4 by pushing the cylinder tip of the catheter tip syringe 6 to the sealing surface in the adapter 4. However, if this is repeated, the sealing surface in the adapter 4 may be deformed.

That is, in the example shown, as shown in FIG. 6(*a*), FIG. 9(*a*) and FIG. 9(*b*), the inner diameter of the adapter 4 is narrowed down towards the tip thereof in almost the middle of the longitudinal direction. The thus narrowed part serves as the sealing surface, and the sealing surface is brought into close contact with the tip of the pouring cylinder 22 of the pouring member main body 2 or the cylinder tip of the catheter tip syringe 6, whereby the sealing performance thereof is allowed to be exhibited. If the same sealing surface in the adapter 4 is used for the pouring member main body 2 and the catheter tip syringe 6, there may be a fear that the catheter tip syringe 6 is forcedly pushed in to increase the inner diameter of the above-mentioned same surface. On the other hand, since the adapter 4 is attached to the pouring member main body 2 by screwing, addition pushing to ensure the sealing performance cannot be conducted, resulting in a possibility of leakage of liquid medicines.

Therefore, on the side surface of the pouring cylindrical part 22, as shown in the figure, it is preferred that a ring-like rib 2*d*, which protrudes in a ring-like form, be formed at a position nearer to the tip than the threads 2*f*. In addition, it is preferred that, when the pouring member main body 2 is screwed to the adapter 4, the circular rib 2*d* be caused to be in close contact with the inner surface of the adapter 4. As a result, sealing performance can be exhibited in a part different from the sealing surface for the catheter tip syringe 6, whereby sealing performance of the adapter 4 for the pouring member main body 2 can be maintained.

Depending on the thickness, elasticity or the like of a catheter 5, the pouring cylindrical part 22, even if it is slightly thick, may be directly inserted to the catheter 5 without passing through the adapter 4, and the catheter 5 can be pressed in and then fixed using the threads 2*f* provided according to the shape advised by a director's notice. Further, when the catheter 5 is formed of a flexible material or for other reasons, as shown in FIG. 5 by a double chain line, there may be a case that the end edge of the catheter 5 is placed over a screw part 2*c*. As a result, there may be a fear that the contents run down along the threads 2*f* revolving the side surface of the pouring cylindrical part 22 and are leaked outside. Forming the above-mentioned ring-like rib 2*d* on the side surface of the pouring cylindrical part 22 is effective to enhance sealing performance between the pouring cylindrical part 22 which has been directly inserted to the catheter 5 and the inner surface of the catheter 5, whereby the contents which have been poured are prevented from leakage by reaching the threads 2*f*.

For the catheter 5 which has a relatively small diameter, the sealing performance between the inner surface of the catheter 5 and the pouring cylindrical part 22 can be enhanced by providing a slip prevention member 2*e*.

The present invention has been explained hereinabove with reference to preferred embodiments. The present invention is, however, not limited to the above-mentioned embodiments, and it is needless to say various modifications are possible within the scope of the present invention.

For example, in the example shown, two rotation prevention sections 3*d* are formed such that they are apart from each other by 180°. However, for example, if the rotation angle required for twisting the sealing part 21 off is smaller than 120°, three rotation prevention sections 3*d* may be formed such that they are apart from one another by 120°. In this way, as in the case mentioned above, it is possible to allow a user to know that the twisting off the sealing part 21 has been completed (or was completed) by a second feel of clicking. It is also possible that, by increasing the width of the rotation prevention sections 3*d* or the like, the outer side surface of the rotation prevention section 3*d* and the engagement projection 2*b* are allowed to abut when the rotation by 120° is attained, thereby to cause the rotation of the unsealing cap 3 to be stopped. As apparent from the above, the number of the rotation prevention section 3*d* can be determined appropriately according to the angle required to twist the sealing part 21 off as long as they are arranged symmetrically with respect to the central axis of the unsealing cap 3.

INDUSTRIAL APPLICABILITY

The pouring member according to the present invention can be used particularly preferably for a container in which contents which have to be required to be unsealed sanitarily are filled and sealed.

The invention claimed is:

1. A pouring member, comprising:

a pouring member main body; and a cylindrical unsealing cap having a closed end at an end thereof and coaxially attached to said pouring member main body, wherein said pouring member main body has a base part, a pouring cylindrical part extending cylindrically from the base part, a sealing part formed at a tip of said pouring cylindrical part, and a thin wall part formed between the sealing part and the pouring cylindrical part, and said sealing part is twisted off with said thin wall part by rotating said unsealing cap which is engaged with said sealing part around a central axis of said unsealing cap, said unsealing cap includes at least two rotation prevention sections extending vertically and downwardly from an end surface of an open end side of said unsealing on and being arranged such that the at least two rotation prevention sections are apart from one another by an angle which is larger than a rotation angle required for twisting off said sealing part and symmetrically with respect to the central axis, and, at substantially a center of a width direction of each rotation prevention section, a recess is formed such that the recess opens to a front end side of the rotation prevention section, and said pouring member main body further includes an engagement projection engaging with said recess in a direction substantially parallel with a direction in which said rotation prevention sections extend vertically and downwardly, said engagement projection being formed at a specific position of a flange part at a boundary between said base part and said pouring cylindrical part of said pouring member main body.

2. The pouring member according to claim 1, further comprising a cylindrical adapter which is coaxially screwed to said pouring member main body after said pouring cylindrical part is unsealed and said unsealing cap is removed, wherein said adapter has a pair of wing parts extending symmetrically in a radial direction of said adapter, and, has, on a side surface along an end edge on a side opposite to said flange part, an abutment part which abuts against said engagement projection when said engagement projection formed on said pouring member main body and said wing parts are aligned on a same plane over the central axis after said pouring member main body is screwed to said adapter, and a loosening prevention rib which has an inclined surface having a height from a side surface of said adapter increasing in a direction opposite to a screwing direction and allows said engagement projection to move over said inclined surface so that the engagement projection enters between said abutment part and said loosening prevention rib when the pouring member main body is screwed to said adapter.

3. The pouring member according to claim 2, wherein threads for screwing said adapter are formed on a side surface of said pouring cylindrical part in a vicinity of said base part of said pouring cylinder cylindrical part, and a ring-like rib which protrudes in a ring-like form is formed on the side surface of said pouring cylindrical part at a position closer to the tip, which is an opposite side to where said threads are formed, with respect to a longitudinal direction of said pouring cylindrical part.

4. The pouring member according to claim 3, wherein, when said pouring member main body is screwed to said adapter, said ring-like rib is in close contact with an inner surface of said adapter.

5. The pouring member according to claim 1, wherein the at least two rotation prevention sections are arranged 180° apart from each other.

6. The pouring member according to claim 5, wherein the at least two rotation prevention sections elastically deform when the at least two rotation prevention sections are released from engagement with the engagement projection.

7. The pouring member according to claim 1, wherein the recess has a first cut-out part or a first curved surface at an outer side surface of the recess so that the engagement projection engages with the recess easily.

8. The pouring member according to claim 7, wherein the engagement projection has a second cut-out part or a second curved surface at a side surface of the engagement projection so that the engagement projection engages with the recess easily.

9. The pouring member according to claim 1, further comprising a support projection extending vertically and downwardly from the end surface of the open end side of said unsealing cap together with the at least two rotation prevention sections to prevent the unsealing cap from inclining or to prevent the at least two rotation prevention sections from breaking when the unsealing cap is capped on the pouring member main body.

* * * * *